United States Patent [19]

Shumway

[11] 4,003,176

[45] Jan. 18, 1977

[54] ROOF TILE SYSTEM

[76] Inventor: Richard A. Shumway, 681 St. Clair St., Eau Gallie, Fla. 32935

[22] Filed: July 24, 1975

[21] Appl. No.: 598,576

[52] U.S. Cl. ..... 52/539; 52/547

[51] Int. Cl.[2] ..... E04D 1/00; E04D 3/362

[58] Field of Search ..... 52/518, 519, 520, 521, 52/522, 537, 538, 545, 546, 547, 526

[56] References Cited

UNITED STATES PATENTS

| | | | |
|---|---|---|---|
| 360,796 | 4/1887 | Crowl | 52/545 |
| 719,514 | 2/1903 | Schall | 52/538 |
| 2,685,852 | 8/1954 | Godel | 52/556 |
| 2,936,723 | 5/1960 | Waldron | 52/390 |
| 3,220,150 | 11/1965 | Besse | 52/537 |
| 3,485,002 | 12/1969 | Baker | 52/314 |
| 3,783,570 | 1/1974 | Storch | 52/520 |

FOREIGN PATENTS OR APPLICATIONS

| | | | |
|---|---|---|---|
| 554,823 | 2/1957 | Belgium | 52/96 |
| 1,292,007 | 3/1962 | France | 52/537 |
| 1,080,835 | 8/1967 | United Kingdom | 52/94 |

*Primary Examiner*—Price C. Faw, Jr.
*Assistant Examiner*—William Randolph
*Attorney, Agent, or Firm*—Duckworth, Hobby, Orman, Allen & Pettis

[57] ABSTRACT

A roof covering system comprises an array of panels, each panel having a recess along a first surface and a protrusion along another surface opposing the first surface, and at an opposite end thereof. The panels are disposed in an overlapping, end-to-end relationship such that the protrusion in one panel extends into the recess of another panel. A support pad is provided and joined with each panel, the support pad being positioned between the ends of the panel and extending from one surface thereof.

9 Claims, 7 Drawing Figures

ROOF TILE SYSTEM

BACKGROUND OF THE INVENTION

1. Field of the Invention

The present invention relates to roof covering systems, and in particular, relates to such systems which render a tiled appearance.

2. Description of the Prior Art

A variety of roof covering systems have been used in the past. In addition to common asphalt shingles and concrete tiles, arcuate tiles have been employed to obtain a decorative appearance.

In U.S. Pat. No. 3,807,113, Turner discloses a roofing panel with interlocking side edges. As disclosed by Turner, each panel is provided with a protrusion and a recess, such that the recess of one panel interlocks with the protrusion of an adjacent panel. The panels are then fixed to the underlying roof by means of nails driven therethrough.

In U.S. Pat. No. 3,852,933, Guzzo discloses an undulating roof panel of extruded plastic or metal, in which one side thereof has a V-shape to provide a rain-protective cover and an interlocking portion for engaging the side edge of a next adjoining panel.

Other roof covering systems employing interlocking constituent parts are found in one or more of the following U.S. Pat. Nos. 2,801,599 to Bordeaux; 1,709,776 to Coburn; 1,819,717 to Mangano; 1,494,707 to Rachlin; 2,677,337 to Neuhaussen; 1,975,304 to Walter; 520,371 to Mullins; and 2,421,415 to Fasold et al. Other prior art references of interest may be found in United States Patent and Trademark Office class 52, subclasses 522 and 526, as well as among other classes and subclasses thereof.

SUMMARY OF THE INVENTION

The present invention is adapted for use with a composition of the type disclosed in my U.S. Pat. No. 3,773,602. Further information regarding this material is disclosed in a technical article prepared by Dr. Ronald F. Zollo, entitled "A Water Extended polyester Material System for Roofing Products", prepared at the University of Miami at Coral Gables, Florida and identified as Report No. UNMER-Y6914-1, dated Jan. 17, 1975.

The roof covering system of the present invention comprises an array of panels, with each panel having first and second opposed surfaces and first and second ends, with a recess along the first surface adjacent the first end thereof, and a protrusion extending from the second surface adjacent the second end. The panels are disposed in an overlapped, end-to-end relationship such that the protrusions in one panel extend into the recess of another panel. Each panel is provided with a support pad joined therewith, each pad positioned between the first and second ends and extending from the first surface of the corresponding one of the panels.

In a preferred embodiment, the first and second surfaces define a plurality of arcuate portions in the panel, each one of the arcuate portions extending across the panel between adjacent ones of the recesses and the protrusions. Suitably, one of the arcuate portions comprises and edge arcuate portion extending to one edge of the panel between the first and second ends, and is adapted to conform with a dam along an opposite edge of an adjoining panel, such that the edge arcuate portion and the dam mate.

THE DRAWINGS

DETAILED DESCRIPTION

Figure 1:
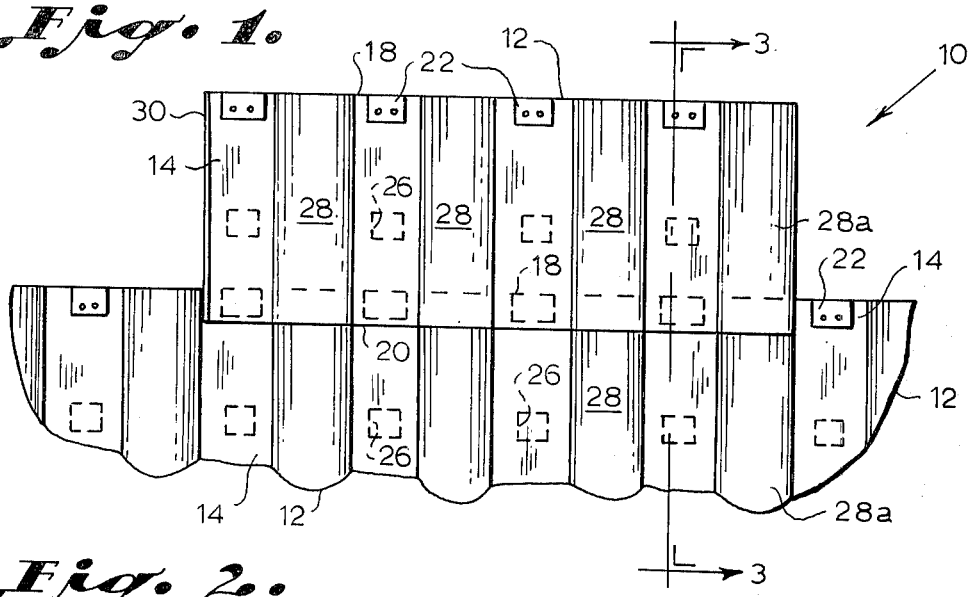
FIG. 1 is a top plan view, partially cut away, of a roof covering system in accordance with the present invention.

The roof covering system in accordance with the present invention will now be described with reference to FIGS. 1, 2 and 3.

The system, referred to generally as 10, includes an array of panels 12, each panel including upper and lower opposed surfaces 14, 16 and first and second opposed ends 18, 20.

Each panel 12 further includes a plurality of protrusions 22 extending from the upper surface 14 adjacent the first end 18, and a plurality of recesses 24 extending into the panel from the lower surface 16 adjacent the second end 20. Each panel 12 has a support pad 26 intermediate the two ends 18, 20 and extending from the lower surface 16 thereof.

Figure 2:
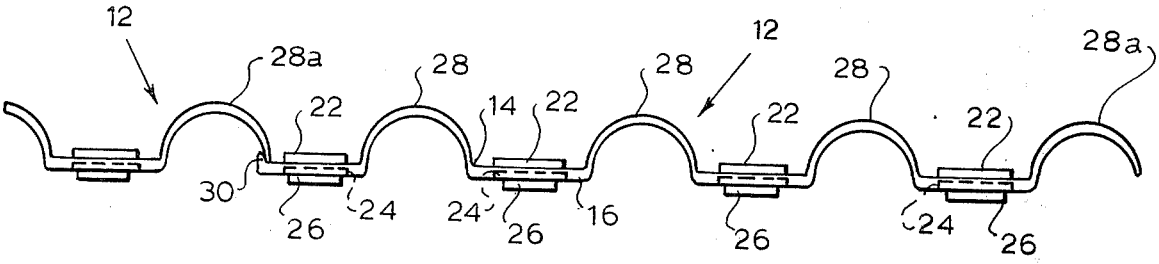
FIG. 2 is an end view of one panel of the system of FIG. 1.
Figure 3:
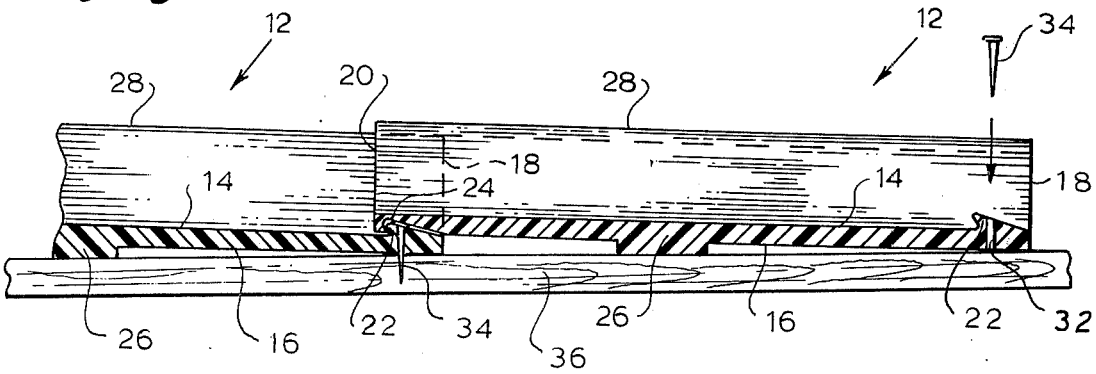
FIG. 3 is a cross-section of a portion of FIG. 1, taken along the lines 3—3.

As is clearly seen in FIGS. 1 and 2, each panel 12 also includes a plurality of arcuate portions 28, with each arcuate portion extending across the panel 12 between the two ends 18, 20, between adjacent recesses 24 and between adjacent protrusions 22. One arcuate portion **28*a* on each panel 12 extends to one edge 30** of the panel.

With continuing reference to FIGS. 1 and 2, each panel 12 includes a dam 30 extending along an edge of each panel 12 between the first and second surfaces 18, 20. Noting FIG. 3, each panel 12 further includes nail holes 32 extending through each protrusion 22, with nails 34 (or equivalent fastening means) being used to fasten each panel 12 to the underlying roof 36.

In use, a first panel 12 is installed adjacent the bottom edge of the roof, by driving nails 34 through the holes 32. An adhesive material is then deposited across the first panel 12, along a path defined by all of the protrusions 22 and across the arcuate portions 28. Thereafter, the next panel 12 is laid out with the protrusion 22 of one panel 12 extending into the recess of the next adjacent panel. As additional panels 12 are added to the array 10 so as to overlap adjacent panels, a second adhesive layer is deposited on the dam 30 of one panel so as to form a moisture barrier between the dam and the edge arcuate portion **28*a*** of the next adjacent panel.

As described thus far, the panels 12 serve to cover the "field" of the roof; that is, the open area not adjacent the roof ridge and eaves.

Other aspects of the roof covering system in accordance with the present invention which are specifically adapted to cooperate with the field panels 12 at the ridge and eaves, are shown and described below with reference to FIGS. 4, 5, 6 and 7.

Figure 4:
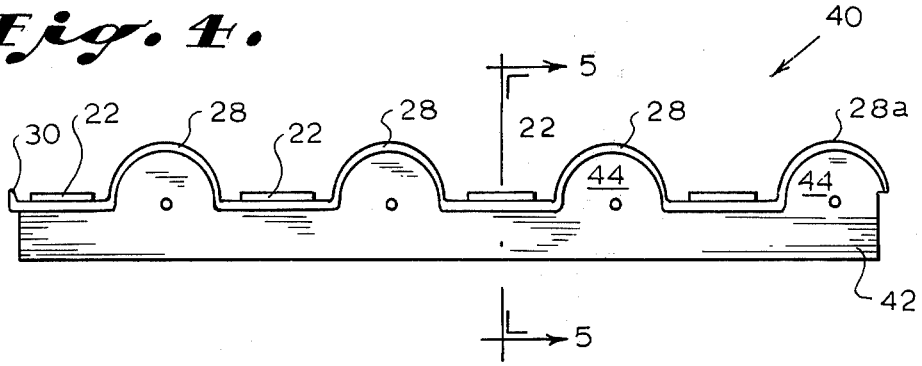
FIG. 4 is a front elevation of another portion of the roof covering system in accordance with the present invention.
Figure 5:
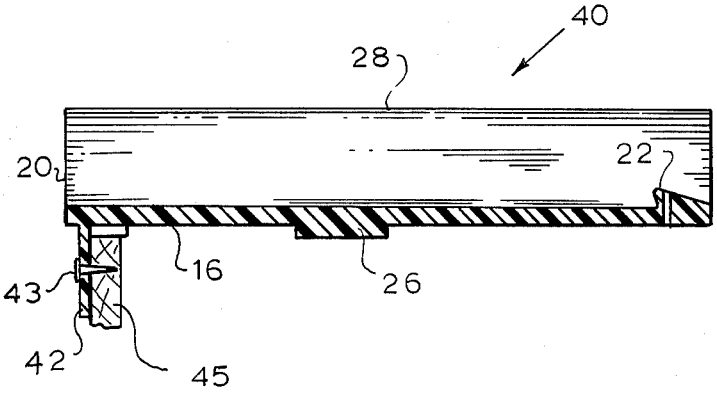
FIG. 5 is a cross-section of FIG. 4, taken along the lines 5—5.

Noting FIGS. 4 and 5, some of the panels, such as the panel 40 in FIG. 4, comprise eave panels and are adapted to extend to an eave of the roof. Each eave panel 40 includes a cosmetic facia member 42 extending substantially normal to the bottom surface 16 adjacent the second end 20. The facia member 42 includes arcuate portions 44 corresponding to the arcuate portions 28 and 28*a* of the eave panel 40. It will be appreciated that the eave panel 40 is adapted to extend to the edge of the roof 36 (not shown in FIGS. 4 and 5), so as to provide a decorative effect. With specific reference to FIG. 5, the eave panel 40 may be fastened by a nail 43, or equivalent fastening means, to the eave face board 45.

Figure 6:
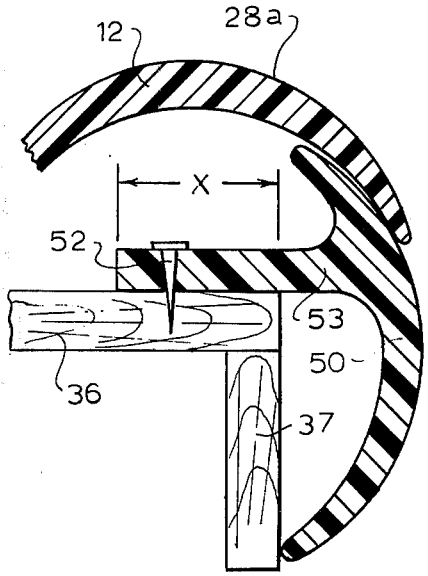
FIG. 6 is a cross-section of another portion of the roof covering system in accordance with the present invention.
Figure 7:
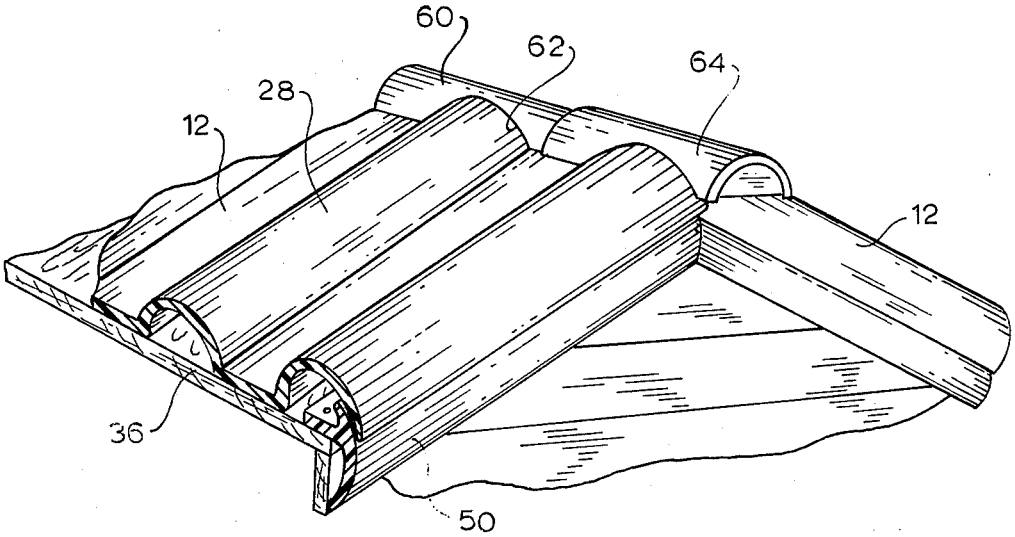
FIG. 7 is a perspective view of the roof covering system of the present invention.

Now referring to FIGS. 6 and 7, some of the field panels 12 of the roof covering system 10 comprise edge panels adapted to extend to an edge 37 of the roof 36. The system 10 further comprises a rake member 50 fastened at the edge of the roof 36, the rake member including an arcuate portion overlapping the roof edge, and being overlapped by the edge arcuate portion 28*a* of the next adjacent field panel 12. The purpose of the rake member 50 is to further provide a cosmetic effect along the edge of the roof. The rake member 50 includes a support 53 extending normal to the arcuate portion thereof, and which is fastened to the roof 36 by a nail or screw 52. The support 53 has a dimension, identified as *x*, in FIG. 6, to allow adjustment to roofs of different dimensions.

With continued reference to FIG. 7, the roof system 10 is further provided with a ridge field cap 60, which is adapted to overlap adjacent field panels 12 on opposite sides of the ridge of the roof 36. The ridge field cap 60 includes arcuate openings 62 therein which are adapted to mate with the arcuate portions 28 of the field panels 12. A ridge end cap 64 is also provided to extend beyond the ends of the field panels 12.

While not limited to such, it is preferred that each panel 12, 40 and the constituent parts thereof including the protrusion 22, the recess 24 and the support pad 26 as well as the arcuate portions 28 thereof, be formed of a unitary, molded member the composition of which suitably is made in conformity with U.S. Pat. No. 3,773,602, which is described above. The resulting roof covering has a pleasing tile appearance and has the shape, texture and color features that are described in the aforementioned patent. Additionally, the roof covering system of the present invention may be easily installed with a minimum of labor, and provides a water-tight covering.

I claim:

1. A roof covering system comprising:

an array of panels, each panel comprising a unitary, molded member having first and second opposing, substantially parallel surfaces and first and second opposing ends, with each panel having a plurality of recesses along said first surface adjacent said first end thereof, and a plurality of protrusions from said second surface adjacent said second end, said first and second surfaces defining a plurality of arcuate portions in said panel, each one of said arcuate portions extending across said panel between adjacent ones of said recesses, and further extending across said panel between adjacent ones of said protrusions, said panels being overlapped end-to-end such that said protrusions in one panel extend into said recesses of another panel;

a plurality of support pads joined with each said panel, each said support pad positioned between said first and second ends and between adjacent ones of said arcuate portions and further extending from said first surface of the corresponding one of said panels;

one of said arcuate portions comprising an edge arcuate portion extending to one edge of said panel between said first and second ends;

a dam extending from said second surface along another edge between said first and second ends of each said panel, said panels disposed edge-to-edge such that said dam in one panel is overlapped by said edge arcuate portion of another panel.

2. The roof covering system recited in claim 1 further comprising a first adhesive layer between said recesses in one panel and said protrusions in a next adjacent panel.

3. The roof covering system recited in claim 2 further comprising a second adhesive layer between said dam in one panel and said edge arcuate portion of another panel.

4. The roof covering system recited in claim 1 wherein some of said panels in said array comprise eave panels and are adapted to extend to an eave of said roof, each said eave panel further comprising:

a cosmetic facia member extending substantially normal to said first and second surfaces adjacent one of said first and second ends, said facia member having arcuate portions corresponding to said arcuate portions of said panel; and means for fastening said eave panel to an eave face board of said roof.

5. The roof covering system recited in claim 1 wherein some of said panels in said array comprise edge panels adapted to extend to an edge of said roof, said system further comprising a rake member fastened to said edge of said roof, said rake member including an arcuate portion overlapping said roof edge, and wherein said edge arcuate portion of said edge panel overlaps said arcuate portion of said rake.

6. The roof cover system recited in claim 5, wherein said rake further comprises:

a support extending substantially normal to said arcuate portion thereof;

means for joining said rake to said roof; and wherein said support has an overlapping dimension with respect to said roof, so as to be adjustable to roofs of different sizes.

7. The roof covering system recited in claim 1 further comprising means for fastening each panel of said array to an underlying roof.

8. The roof covering system recited in claim 7 wherein said fastening means comprises:

said panels including holes therethrough at said protrusions; and nails extending through said holes and fastening said panels to said roof.

9. The roof covering system recited in claim 1, further comprising a ridge cap adapted to overlap adjacent ones of said panels across the ridge of a roof being covered, said ridge cap comprising arcuate members extending sybstantially normal to said arcuate portions of said panels and including an arcuate opening therein adapted to overlap said panel arcuate portions.

* * * * *